US007352128B2

(12) United States Patent
Yoon

(10) Patent No.: US 7,352,128 B2
(45) Date of Patent: Apr. 1, 2008

(54) GAS INJECTION PORT STRUCTURE OF FLAT FLUORESCENT LAMP

(75) Inventor: Jae Doo Yoon, Yongdam-ri (KR)

(73) Assignee: Mirae Corporation, Chungcheongnam-Do (KR)

( * ) Notice: Subject to any disclaimer, the term of this patent is extended or adjusted under 35 U.S.C. 154(b) by 400 days.

(21) Appl. No.: 11/037,239

(22) Filed: Jan. 19, 2005

(65) Prior Publication Data

US 2006/0061274 A1 Mar. 23, 2006

(30) Foreign Application Priority Data

Sep. 21, 2004 (KR) ..... 10-2004-0075387

(51) Int. Cl.
*H01J 19/70* (2006.01)

(52) U.S. Cl. ..... 313/553; 313/549; 417/48; 417/51

(58) Field of Classification Search ..... None
See application file for complete search history.

(56) References Cited

U.S. PATENT DOCUMENTS 4,723,093 A * 2/1988 Nolan ..... 313/643
6,049,086 A * 4/2000 Foggiato et al. ..... 250/504 R
2002/0021080 A1* 2/2002 Kanno et al. ..... 313/494

FOREIGN PATENT DOCUMENTS

JP 01-231255 * 9/1989

* cited by examiner

*Primary Examiner*—Ashok Patel
(74) *Attorney, Agent, or Firm*—Ked & Associates, LLP

(57) ABSTRACT

A gas injection port structure for a flat fluorescent lap (FFL) is provided. The FFL has a flat lower plate and an upper plate that form a channel therebetween, and at least one gas injection port in communication with the channel. The gas injection port may be formed at a predetermined position on the upper plate so that a height of the gas injection port is level with or lower than a height of the channel. The gas injection port may contain a mercury getter and a sealing material having a passage formed therethrough so that mercury vapor may be injected into the channel and then the channel sealed. The gas injection port minimizes a thickness of the FFL, and improves durability of the FFL.

20 Claims, 9 Drawing Sheets

GAS INJECTION PORT STRUCTURE OF FLAT FLUORESCENT LAMP

BACKGROUND OF THE INVENTION

1. Field of the Invention

The present invention relates, in general, to flat fluorescent lamps used as backlight units (BLU) in display devices, such as LCDs, and, more particularly, to a gas injection port structure of a flat fluorescent lamp (FFL), which is configured such that a gas injection port of the FFL is level with or lower than the height of a protruding channel provided on an upper plate of the FFL, thus minimizing the thickness of the FFL and accomplishing the recent trend of thinness of products having the FFLs.

2. Description of the Related Art

Generally, to produce a fluorescent lamp, first, a hollow glass body having a specific shape is provided by appropriately processing glass at a high temperature. Second, air is drawn out of the hollow glass body through a gas injection port so that the internal pressure of the glass body is reduced to form vacuum, and, thereafter, inert gas is injected into the vacuumized glass body through the gas injection port. After the first and second processes have been completed, the gas injection port is sealed. Conventional fluorescent lamps produced through the above-mentioned process may have various shapes, for example, linear shapes, specifically curved shapes and flat shapes. To allow the air to be drawn out of the hollow glass body of a fluorescent lamp to form a vacuum and the inert gas to be injected into the vacuumized glass body, a gas injection port is provided at each end of the glass body. Furthermore, an electrode may be provided at the gas injection port when necessary.

FIG. 1 is a perspective view illustrating the construction of a conventional flat fluorescent lamp (FFL) 10. FIG. 2 is a sectional view illustrating a gas injection port 14 of the FFL 10 of FIG. 1. As shown in the drawings, the conventional FFL 10 comprises a lower plate 11 having a flat shape, and an upper plate 12 having a protruding serpentine channel 13 and being integrated with the lower plate 11 into a single body. In the conventional FFL 10, the protruding serpentine channel 13 is formed as a continuous long channel having a serpentine shape, both ends of which are separated from each other.

As shown FIGS. 1 and 2, the serpentine channel 13 that forms the lamp part of the FFL 10 is provided with a vertical gas injection port 14 at each end thereof. The gas injection port 14 is directed upwards from each end of the serpentine channel 13 on the upper plate 12 so that the port 14 protrudes to a predetermined height. During a process of manufacturing the FFL 10, air is drawn out of the channel 13 through the gas injection ports 14 to form a vacuum in the channel 13, and, thereafter, inert gas is injected into the vacuumized channel 13 prior to sealing the gas injection ports 14 using a sealing material.

However, the gas injection ports 14 of the conventional FFL 10 are directed upwards from the opposite ends of the channel 13 as described above, thus undesirably increasing the thickness of the FFL 10. The above-mentioned increase in the thickness of the FFL 10 also thickens the display products, such as LCDs, produced using the FFLs 10.

In addition to the above-mentioned problem, the upward directed gas injection ports 14 may induce damage to the upper plate 12 during the processes of drawing air out of the channel 13, injecting inert gas into the channel 13, and sealing the ports 14 after the inert gas has been injected into the channel 13. Thus, the above-mentioned processes must be carefully executed, reducing work efficiency during the processes. Furthermore, to avoid damage to the gas injection ports 14 during the above-mentioned processes, the FFL 10 must be placed in a horizontal position from the start to the end of the processes, so that the FFL 10 requires a large working area.

In an effort to overcome the above-mentioned problems, another conventional FFL 20 having horizontal gas injection ports 24 as shown in FIGS. 3 through 5 has been proposed. As shown in the drawings, one or more horizontal gas injection ports 24 are provided on the FFL 20 at predetermined positions of a channel 23. Each of the gas injection ports 24 has a predetermined length and a throat having a semicircular cross-section, the sectional area of which is gradually reduced in a direction towards the channel 23. A gas injection hole 25 is formed through a lower plate 21 of the FFL 20 so that the hole 25 communicates with the interior of an associated gas injection port 24.

Furthermore, to draw air out of the channel 23 of an upper plate 22 of the FFL 20 and to inject inert gas into the channel 23 through the gas injection ports 24, a nozzle 30 is provided at the inlet of each gas injection hole 25 of the lower plate 21. The inside end of the nozzle 30 is provided with a flange 31 which has a diameter larger than the diameter of the gas injection hole 25, with a stopper 32 placed on the flange 31 restricting the undesired flow of sealing material 26 out of the gas injection port 24. Furthermore, an elastic sealing member 33 is interposed between the gas injection hole 25 and the flange 31 provided at the end of the nozzle 30, thus providing a desired seal at the junction of the gas injection hole 25 and the flange 31. Due to the gas injection ports 24 having the nozzles 30, the processes of drawing air out of the channel 23 and injecting inert gas into the vacuumized channel 23 can be efficiently executed.

The sealing material 26 is provided in each of the gas injection ports 20, with a passage 27 formed through the sealing material 26 in each of the gas injection ports 20. Thus, the gas injection ports 24 communicate with the channel 23 of the upper plate 22 through the passages 27. Due to the passages 27, the sealing materials 26 do not interfere with the flow of air or inert gas during the processes of drawing the air out of the channel 23 and injecting the inert gas into the channel 23. After the inert gas has been injected into the channel 23 through the gas injection ports 24, the sealing material 26 is fused using a heater H. Thus, the passage 27 in each of the gas injection ports 24 is closed, so that the channel 23 is completely isolated from the atmosphere.

As described above, each of the gas injection ports 24 of the conventional FFL 20 illustrated in FIGS. 3 through 5 must be provided with a nozzle 30 for drawing air out of the channel 23 and for injecting inert gas into the channel 23. Therefore, the FFL 20 is problematic in that it is difficult to produce the FFL 20. Furthermore, the gas injection ports 24 have a complex construction, causing difficulty and reducing work efficiency during the process of injecting the inert gas into the channel 23.

SUMMARY OF THE INVENTION

Accordingly, the present invention has been made keeping in mind the above problems occurring in the related art, and an object of the present invention is to provide a gas injection port structure of a flat fluorescent lamp (FFL), which is configured such that a gas injection port is formed as a horizontal port lying on an edge of an upper plate of the FFL without being higher than the height of a protruding channel provided on the upper plate, thus minimizing the thickness of the FFL, and which simplifies the construction of the gas injection port and allows air to be easily drawn out of the channel and allows inert gas to be easily injected into the vacuumized channel, and, furthermore, allows the gas injection port sealing operation that follows the injection of the inert gas into the channel to be easily performed, thus improving work efficiency while manufacturing the FFLS.

In order to achieve the above object, according to a first embodiment of the present invention, there is provided a gas injection port structure of an FFL, the FFL having a flat lower plate, an upper plate having a protruding channel and being integrated with the lower plate into a single body, and a gas injection port provided on the FFL, wherein the gas injection port is formed on the upper plate of the FFL at a predetermined position while lying on the upper plate so that the gas injection port is level with or lower than the height of the protruding channel of the upper plate. The gas injection port may contain therein both a mercury getter and a sealing material having a passage formed through the sealing material from a first end to a second end of the sealing material. Furthermore, a gas injection pipe may be inserted into the inlet of the gas injection port, with a sealing tube interposed between the gas injection pipe and the gas injection port.

According to a second embodiment of the present invention, there is provided a gas injection port structure of an FFL, comprising two gas injection ports formed on the upper plate of the FFL at two predetermined positions while lying on the upper plate so that the gas injection ports are level with or lower than the height of the protruding channel of the upper plate. At least one of the two gas injection ports may contain therein a sealing material having a passage formed through the sealing material from a first end to a second end of the sealing material, with a gas injection pipe inserted into the gas injection port and a sealing tube interposed between the gas injection pipe and the gas injection port. Furthermore, a mercury vapor diffusing pipe, which is closed at a first end thereof and contains a mercury getter therein, may be inserted at a second end thereof into the other gas injection port, with a sealing tube interposed between the mercury vapor diffusing pipe and the gas injection port.

According to a third embodiment of the present invention, there is provided a gas injection port structure of an FFL, comprising a gas injection port formed on the upper plate of the FFL at a predetermined position while lying on the upper plate so that the gas injection port is level with or lower than the height of the protruding channel of the upper plate; a mercury vapor diffusing port formed on the upper plate at a side of the gas injection port; a mercury vapor diffusing pipe closed at a first end thereof and containing a mercury getter therein, and inserted at a second end thereof into the mercury vapor diffusing port, with a sealing tube interposed between the mercury vapor diffusing pipe and the mercury vapor diffusing port; and a connection passage connecting the mercury vapor diffusing port to the gas injection port, thus allowing the mercury vapor diffusing port to communicate with the gas injection port. The gas injection port may contain therein a sealing material having a passage formed through the sealing material from a first end to a second end of the sealing material. Furthermore, a gas injection pipe may be inserted into the gas injection port, with a sealing tube interposed between the gas injection pipe and the gas injection port.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
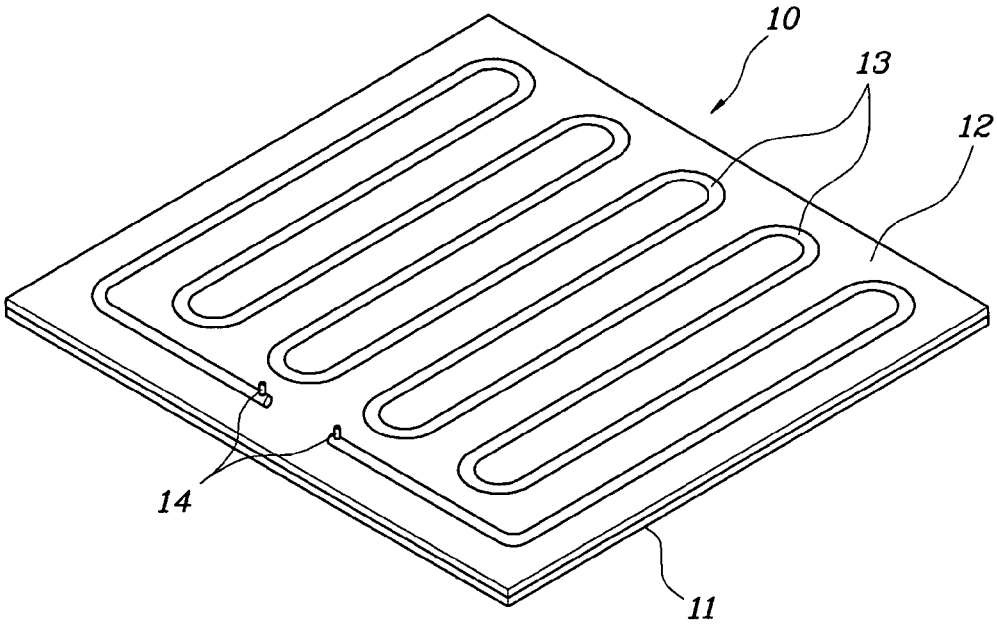
Fig. 1 CONVENTIONAL ART
FIG. 1 is a perspective view illustrating the construction of a conventional flat fluorescent lamp (FFL)
Figure 2:
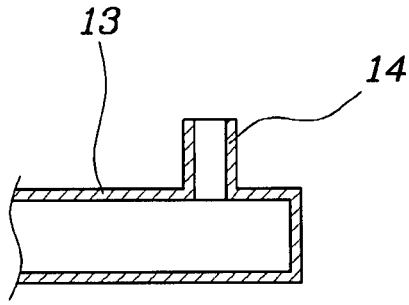
Fig. 2 CONVENTIONAL ART
FIG. 2 is a sectional view illustrating a gas injection port of the FFL of FIG. 1.
Figure 3:
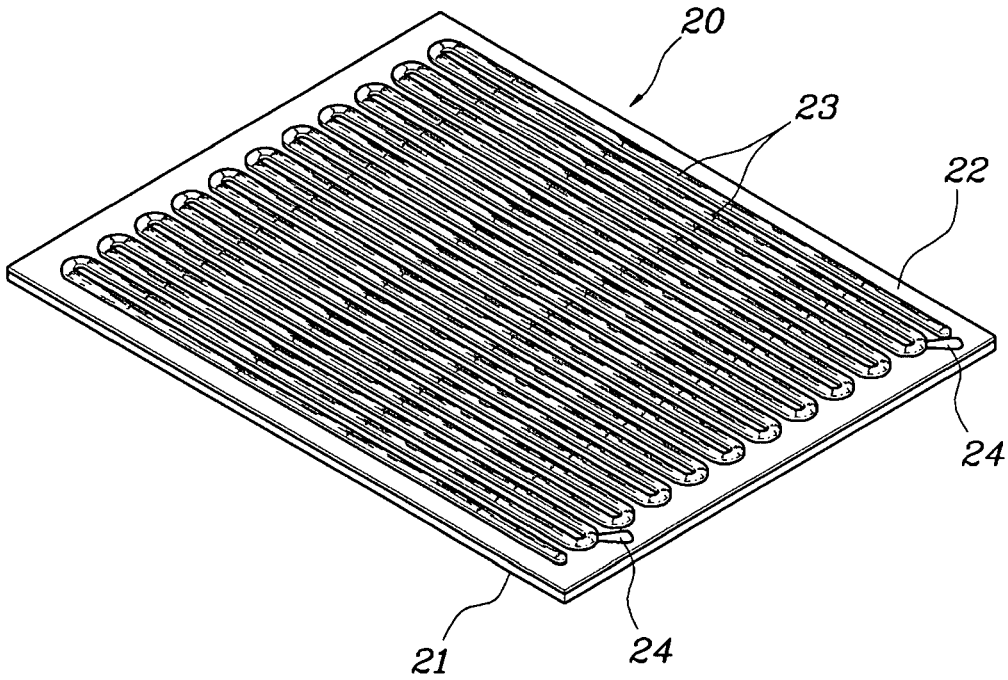
Fig. 3 CONVENTIONAL ART
FIG. 3 is a perspective view illustrating the construction of another conventional FFL.
Figure 4:
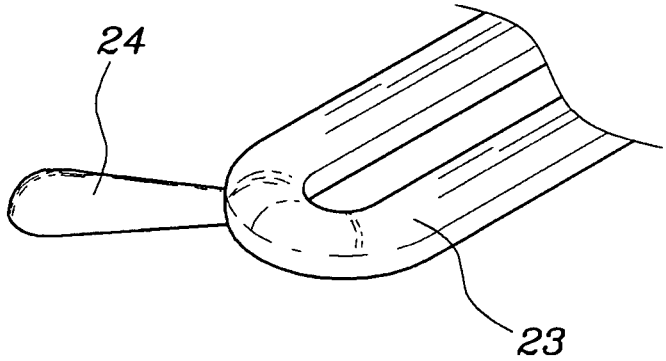
Fig. 4 CONVENTIONAL ART
FIG. 4 is a perspective view illustrating a gas injection port of the FFL of FIG. 3.
Figure 5:
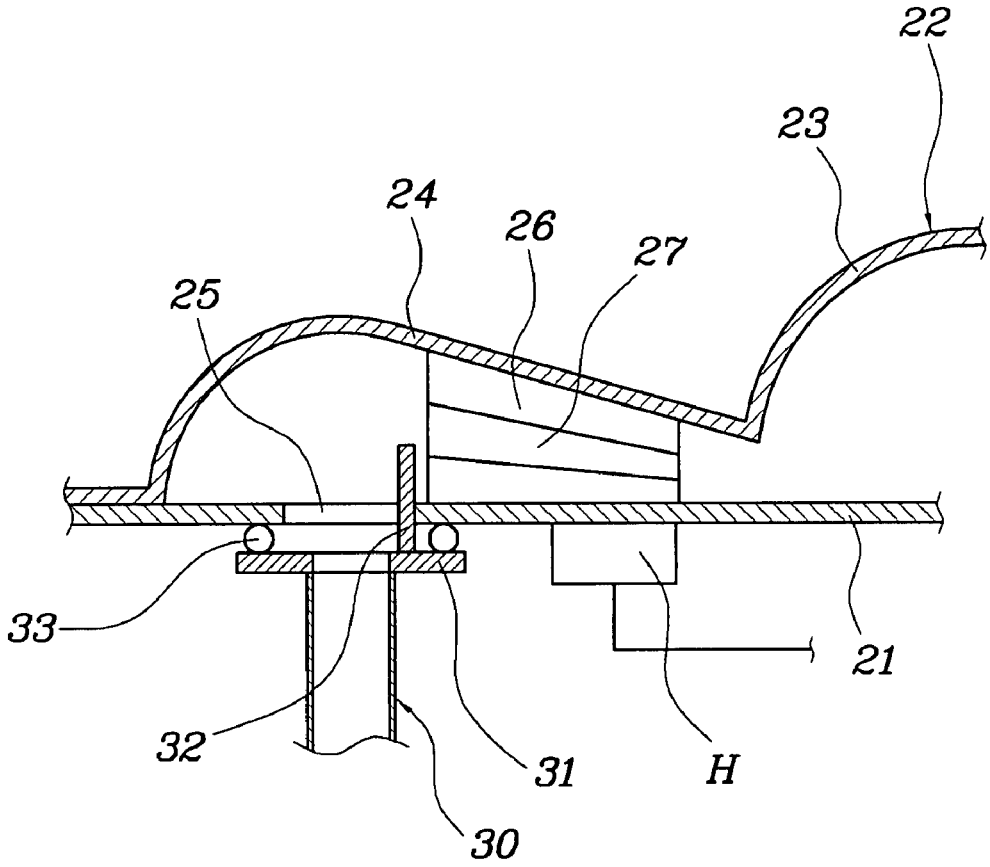
Fig. 5 CONVENTIONAL ART
FIG. 5 is a sectional view illustrating a method of injecting gas into a channel of the FFL through the gas injection port of FIG. 4.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 6:
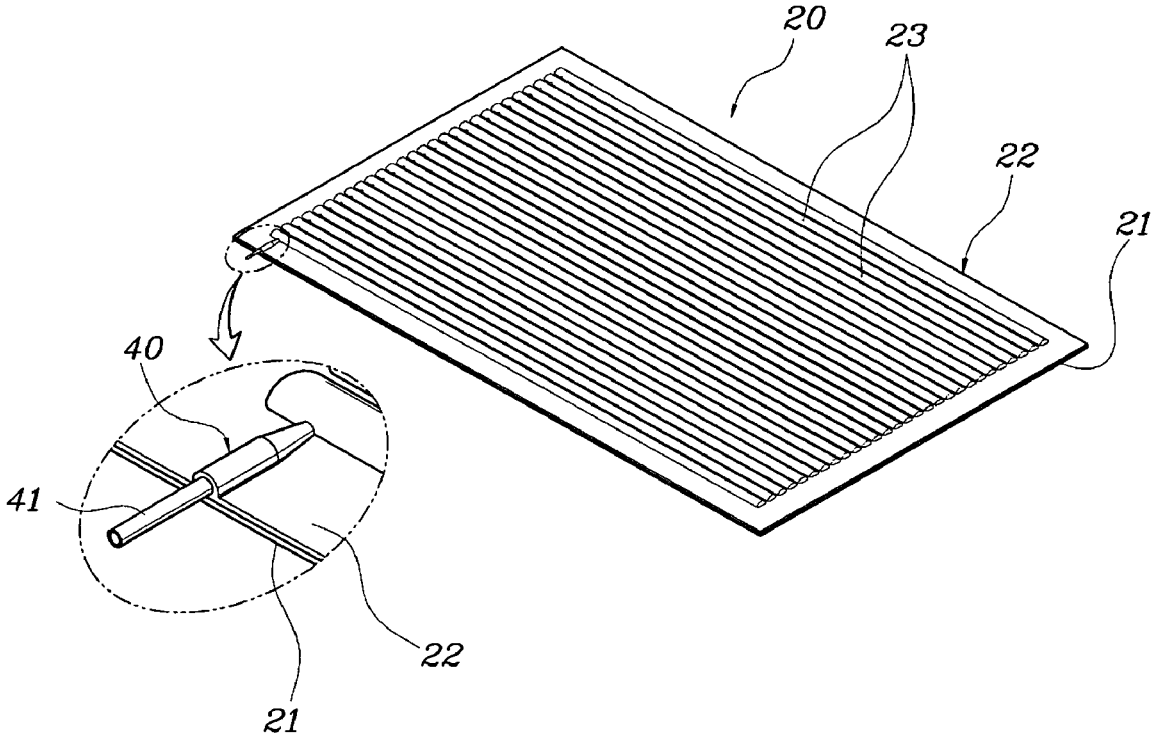
FIG. 6 is a perspective view illustrating the construction of an FFL according to a first embodiment of the present invention.
Figure 7:
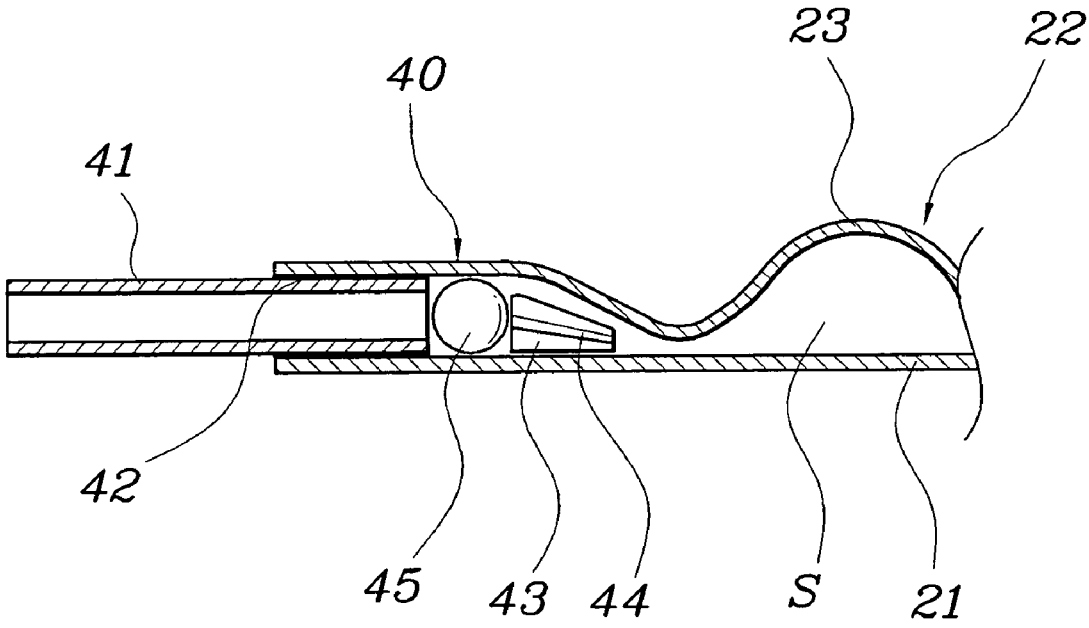
FIG. 7 is a sectional view illustrating a gas injection port of the FFL of FIG. 6.

FIG. 6 is a perspective view illustrating the construction of a flat fluorescent lamp (FFL) according to a first embodiment of the present invention. FIG. 7 is a sectional view illustrating a gas injection port of the FFL of FIG. 6.

As shown in the drawings, the gas injection port structure of the FFL 20 according to the first embodiment of the present invention is configured such that only one gas injection port 40 is formed on an upper plate 22 at a predetermined position. In a detailed description, the gas injection port 40 is formed on the upper plate 22 at a position outside a protruding channel 23 such that the port 40 communicates with the internal space S of the channel 23. The gas injection port 40 is a horizontal port that lies on the upper plate 22 such that the port 40 is level with or lower than the height of the channel 23. Thus, the thickness of the FFL 20 is reduced, accomplishing the recent trend of thinness of products using the thin FFLs 20.

The gas injection port 40 is provided to draw air out of the internal space S of the channel 23, thus forming a vacuum, and, thereafter, to inject inert gas into the vacuumized space S of the channel 23. Thus, the location of the gas injection port 40 on the FFL 20 is determined such that the port 40 most efficiently draws air out of the internal space S and most efficiently injects inert gas into the space S.

A sealing material 43, which is fused when heated, is provided in the gas injection port 40, with a passage 44 formed through the sealing material 43 such that the passage 44 completely extends from one end to the other end of the sealing material 43. The passage 44 serves as a path, through which air passes outwards when the air is drawn out of the internal space S of the channel 23, inert gas passes inwards when the inert gas is injected into the space S, and mercury vapor flows inwards when the mercury vapor is diffused into the space S as will be described in detail later herein. After the above-mentioned processes are completed, the sealing material 43 is heated and fused, thus sealing the gas injection port 40.

A mercury getter 45 impregnated with mercury is placed in front of the inlet of the passage 44 formed through the sealing material 43 in the gas injection port 40. The mercury getter 45 is used for diffusing mercury vapor into the internal space S of the channel 23 after air has been drawn out of the space S and inert gas has been injected into the space S. To diffuse the mercury vapor into the space S containing inert gas, high-frequency waves are transmitted to the mercury getter 45 so that the mercury getter 45 ruptures. Thus, mercury vapor from the ruptured getter 45 is diffused into the space S of the channel 23.

When the mercury vapor has been completely diffused into the internal space S of the FFL 20, air in the gas injection port 40 is heated using a heater (not shown) so that the sealing material 43 is fused and seals the gas injection port 40.

Furthermore, a gas injection pipe 41 is axially inserted into the inlet of the gas injection port 40. In the present invention, to provide a desired seal at the junction of the gas injection pipe 41 and the gas injection port 40, a sealing tube 42 is preferably interposed between the outer surface of the pipe 41 and the inner surface of the port 40. The gas injection pipe 41 is used for connecting a vacuum pump's nozzle (not shown) to the gas injection port 40 when air is drawn out of the channel 23 to form vacuum, or connecting an inert gas injector's nozzle (not shown) to the gas injection port 40 when inert gas is injected into the vacuumized space S.

Figure 8:
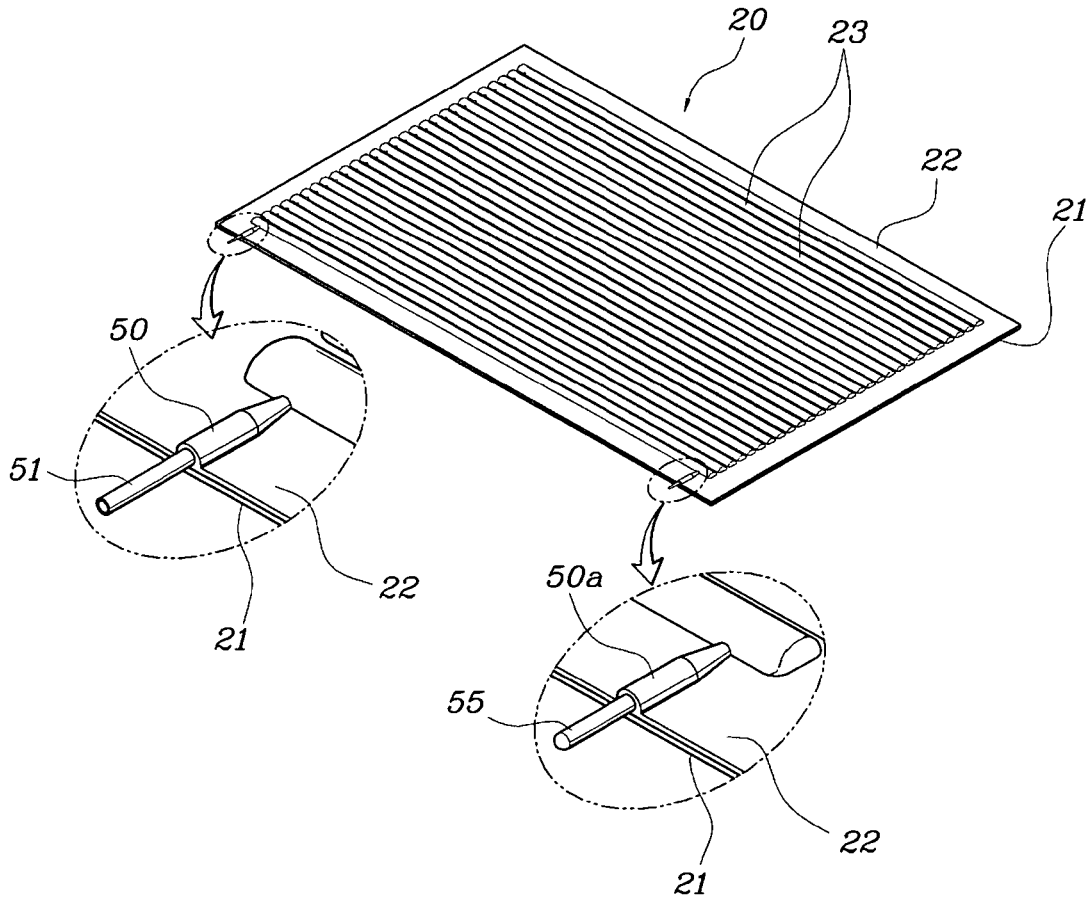
FIG. 8 is a perspective view illustrating the construction of an FFL according to a second embodiment of the present invention.
Figure 9:
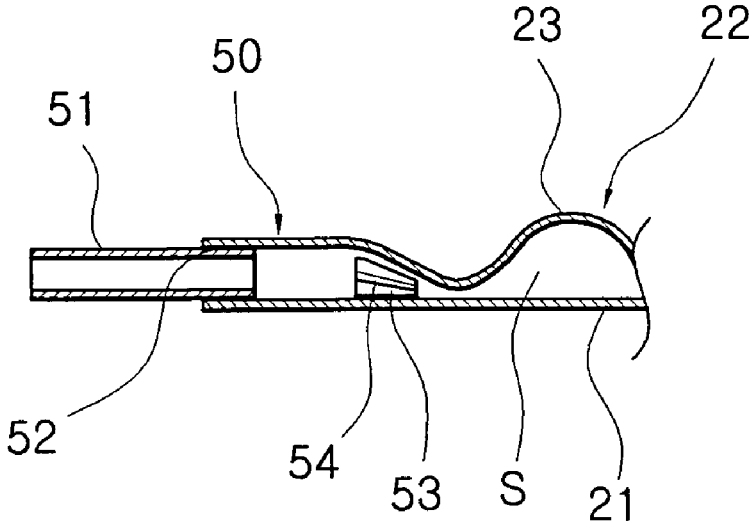
FIGS. 9 and 10 are sectional views illustrating gas injection ports of the FFL of FIG. 8.
Figure 10:
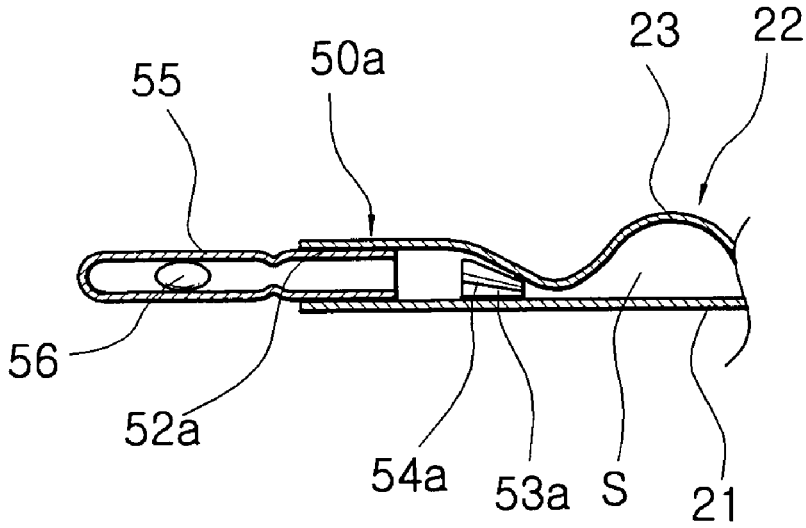

In the above-mentioned first embodiment of the present invention, only one gas injection port 40 is provided on the FFL 20 at a predetermined position. However, two gas injection ports may be provided on the FFL 20 as shown in FIGS. 8, 9 and 10 which illustrate a second embodiment of the present invention. In the second embodiment of the present invention, the two gas injection ports 50 and 50*a* provided on the upper plate 22 of the FFL 20 at two predetermined positions are separately used such that the first gas injection port 50 is used for drawing air out of and injecting inert gas into the internal space S of the channel 23, while the second gas injection port 50*a* is provided with a mercury getter 56 therein, thus being used for diffusing mercury vapor into the space S of the channel 23.

The construction of the first gas injection port 50 used for drawing air out of and injecting inert gas into the internal space S of the channel 23 is illustrated in FIG. 9, while the construction of the second gas injection port 50*a* provided with the mercury getter 56 therein and used for diffusing mercury vapor into the space S is illustrated in FIG. 10. As shown in FIGS. 9 and 10, a gas injection pipe 51 is axially and closely inserted into the inlet of the first gas injection port 50, with a sealing tube 52 interposed between the pipe 51 and the port 50 to provide a desired seal. A mercury vapor diffusing pipe 55 closed at an outside end thereof and containing the mercury getter 56 therein is axially and closely inserted at an open inside end thereof into the inlet of the second gas injection port 50*a*, with a sealing tube 52*a* interposed between the diffusing pipe 55 and the second gas injection port 50*a* to provide a desired seal.

In a similar manner as that described for the first embodiment, a sealing material 53, 53*a* having a passage 54, 54*a* is provided in each gas injection port 50, 50*a* of FIGS. 9 and 10. Therefore, after air has been drawn out of the internal space S of the channel 23 and inert gas has been injected into the space S through the first gas injection port 50, the sealing material 53 in the first gas injection port 50 is heated and fused using a heater (not shown), thus sealing the first gas injection port 50.

Thereafter, high-frequency waves are transmitted to the mercury getter 56 of the second gas injection port 50*a*, thus rupturing the mercury getter 56 and diffusing mercury vapor from the ruptured mercury getter 56 into the space S of the channel 23. After the diffusion of the mercury vapor into the space S, the sealing material 53*a* in the second gas injection port 50*a* is heated and fused using a heater (not shown) in the same manner as that described for the first gas injection port 50, thus sealing the second gas injection port 50*a*. The mercury getter 56 is placed in the diffusing pipe 55 that is axially and closely inserted into the inlet of the second gas injection port 50*a*, with the sealing tube 52*a* interposed between the diffusing pipe 55 and the second gas injection port 50*a* to provide a desired seal.

In the gas injection port structure according to the second embodiment, the first gas injection port 50 used for drawing air out of and injecting inert gas into the internal space S of the channel 23 and the second gas injection port 50*a* provided with the mercury getter 56 and used for diffusing mercury vapor into the space S are separately provided on the FFL 20, unlike the first embodiment. Thus, heat generated during the processes of drawing air out of and injecting inert gas into the space S of the channel 23 and the high-frequency waves transmitted to the mercury getter 56 during the process of diffusing mercury vapor into the space S are not concentrated on one gas injection port, but are distributed to the two gas injection ports 50 and 50*a*. Thus, the gas injection port structure according to the second embodiment is advantageous in that it prevents damage or breakage of the gas injection ports.

Furthermore, due to the separate gas injection ports which comprise the first gas injection port for drawing air out of and injecting inert gas into the internal space of the FFL, and the second gas injection port containing a mercury getter for diffusing mercury vapor into the internal space of the FFL, the gas injection port structure of the second embodiment reduces the number of bad quality FFLs caused by undesired removal of the mercury getters from the gas injection ports.

Figure 11:
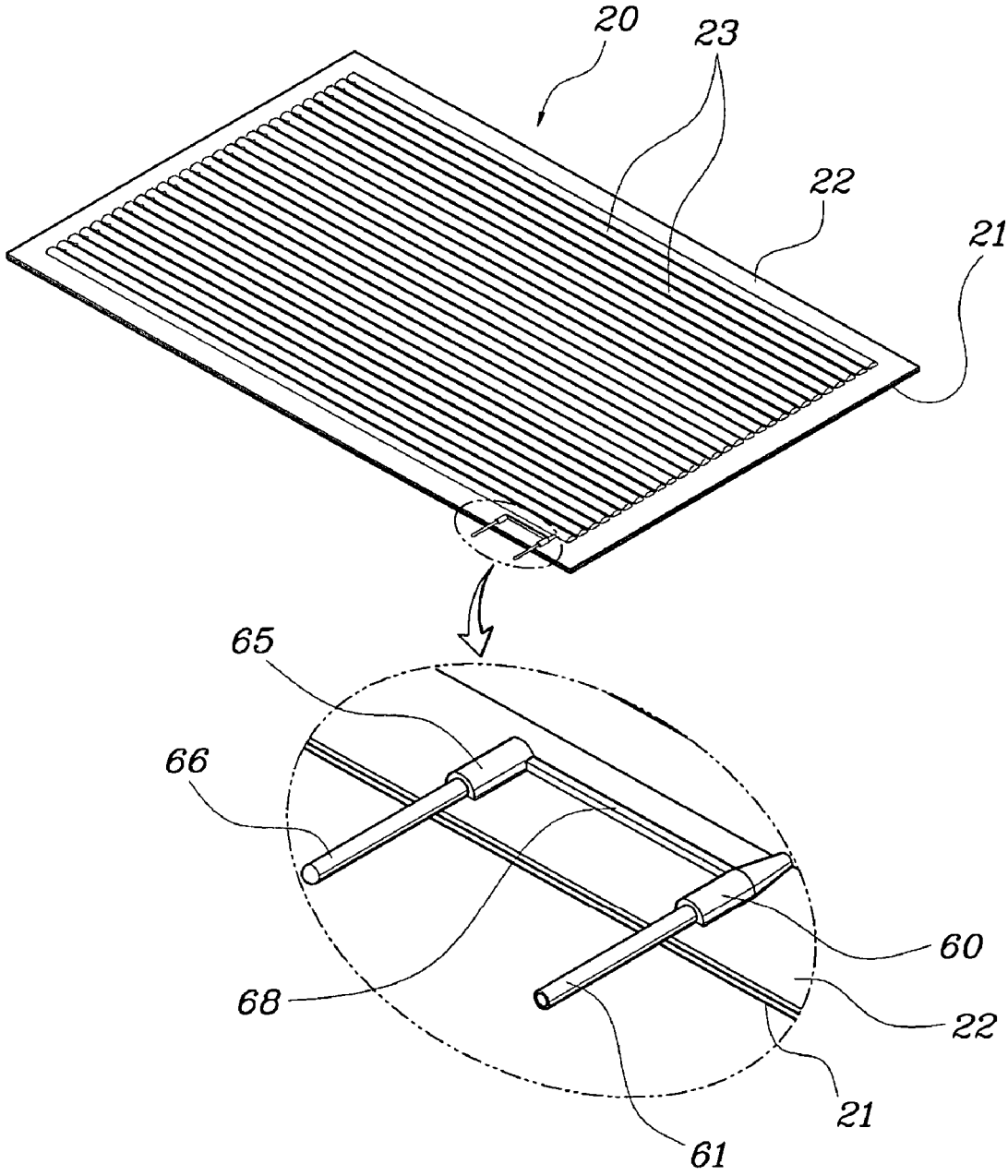
FIG. 11 is a perspective view illustrating the construction of an FFL according to a third embodiment of the present invention.
Figure 12:
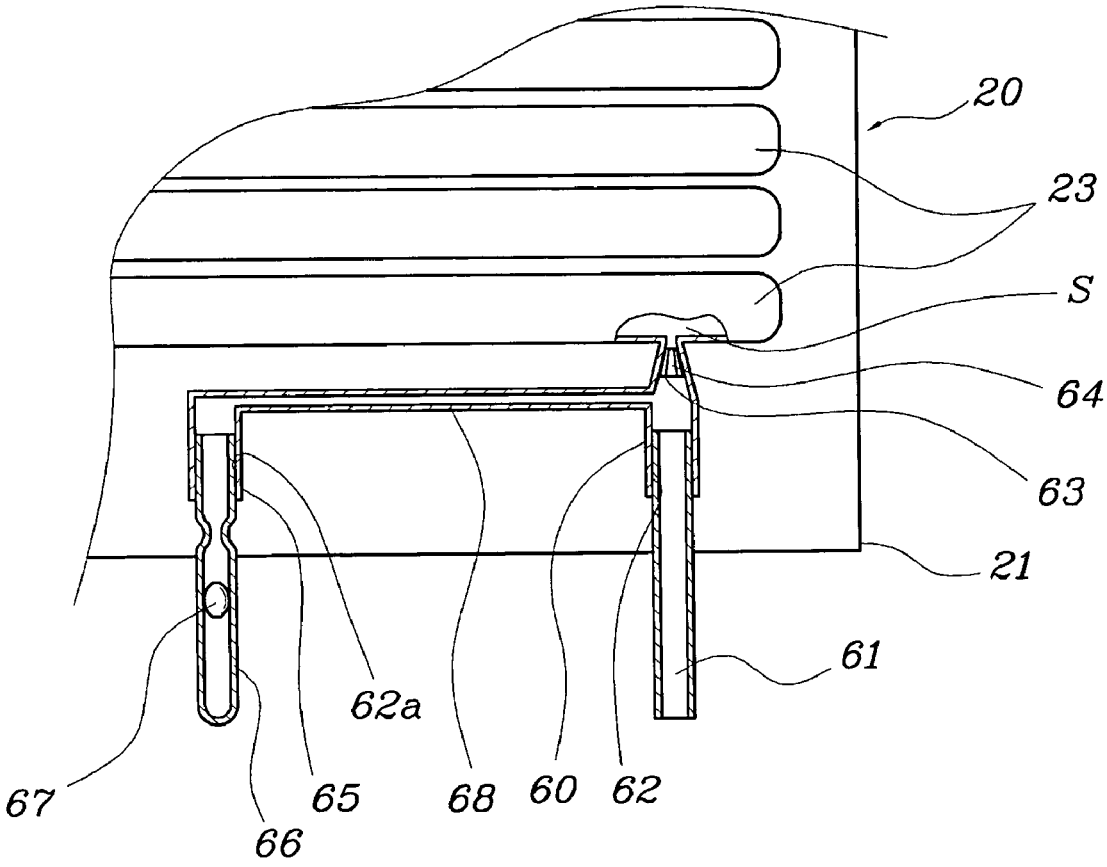
FIG. 12 is a sectional view illustrating a gas injection port of the FFL of FIG. 11.

FIGS. 11 and 12 are views illustrating the construction of a gas injection port structure of an FFL according to a third embodiment of the present invention. In the third embodiment, a gas injection port 60 is formed on the upper plate 22 of the FFL 20 at a predetermined position, with a mercury vapor diffusing port 65 formed on the upper plate 22 at a side of the gas injection port 60. A mercury vapor diffusing pipe 66 closed at an outside end thereof and containing a mercury getter 67 therein is axially and closely inserted at an open inside end thereof into the inlet of the mercury vapor diffusing port 65, with a sealing tube 62*a* interposed between the diffusing pipe 66 and the diffusing port 65 to provide a desired seal. The mercury vapor diffusing port 65 is connected to the gas injection port 60 through a connection passage 68 so that the diffusing port 65 communicates with the gas injection port 60.

In other words, the gas injection port 60 is formed on the FFL 20 to directly communicate with the internal space S of the channel 23, while the mercury vapor diffusing port 65 is formed on the FFL 20 such that the port 65 does not communicate with the internal space S, but communicates with the gas injection port 60 through the connection passage 68. Thus, the gas injection port 60 is used for drawing air out of and injecting inert gas into the internal space S, while the mercury vapor diffusing port 65 is used for diffusing mercury vapor into the space S. A sealing material 63 having a passage 64 is placed in the gas injection port 60 at a position beyond a juncture at which the connection passage 68 is joined to the gas injection port 60.

After the processes of drawing air out of and injecting inert gas into the internal space S of the channel 23 through the gas injection port 60 and the process of diffusing mercury vapor into the space S by transmitting high-frequency waves to the mercury getter 67 in the mercury vapor diffusing port 65 have been completed, the gas injection port 60 is heated using a heater (not shown), thus fusing the sealing material 63 and sealing the gas injection port 60.

In the third embodiment, a gas injection pipe 61 and the mercury vapor diffusing pipe 66 are axially and closely inserted into the inlets of the gas injection port 60 and the mercury vapor diffusing port 65, respectively, with a sealing tube 62, 62*a* interposed between each pipe 61, 66 and an associated port 60, 65 to provide a desired seal.

As described above, the gas injection port structure of the FFL according to the third embodiment of the present invention yields the same advantages as those described for the first and second embodiments. Furthermore, the third embodiment improves work efficiency when manufacturing the FFL, because the gas injection port 60 and the mercury vapor diffusing port 65 are placed adjacent to each other.

Furthermore, in the first, second and third embodiments of the present invention, when the processes of drawing air out of and injecting inert gas into the internal space of the channel of the FFL and the process of diffusing mercury vapor into the internal space of the channel have been completed, the gas injection pipe and the mercury vapor diffusing pipe may be removed from the gas injection port and the mercury vapor diffusing port, or cut such that ends of the pipes become level with the ends of the ports.

As apparent from the above description, the present invention provides a gas injection port structure of a flat fluorescent lamp (FFL), which is configured such that a gas injection port is formed as a horizontal port lying on an edge of an upper plate of the FFL without being higher than the height of a protruding channel provided on the upper plate, thus minimizing the thickness of the FFL and accomplishing the recent trend of thinness of products having the FFLs.

Furthermore, the present invention simplifies the construction of the gas injection port and allows air to be easily drawn out of the channel and allows inert gas to be easily injected into the vacuumized channel, and, furthermore, allows the gas injection port sealing operation that follows the injection of the inert gas into the channel to be easily performed, thus improving work efficiency while manufacturing the FFLs.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A gas injection structure for a flat fluorescent lamp (FFL), the FFL having a lower plate, an upper plate, and a channel formed therebetween, the structure comprising:

a gas injection port provided at a first predetermined position on the upper plate;

a mercury vapor diffusing port provided at a second predetermined position on the upper plate, to a side of the gas injection port;

a mercury vapor diffusing pipe having an open end and a closed end, the open end being inserted into the mercury vapor diffusing port, the mercury vapor diffusing pipe having a mercury getter provided therein; and a connection passage that connects the mercury vapor diffusing port to the gas injection port.

2. The structure of claim 1, further comprising a gas injection pipe inserted into the gas injection port.

3. The structure of claim 2, further comprising a sealing tube positioned between the gas injection pipe and the gas injection port.

4. The structure of claim 1, further comprising a sealing material provided in the gas injection port, the sealing material comprising a passage extending from a first end of the sealing material to a second end of the sealing material.

5. The structure of claim 4, wherein the sealing material is configured to close off the passage extending therethrough in response to heat applied thereto so as to form a seal within the gas injection port.

6. The structure of claim 1, wherein the gas injection port is formed at an edge portion of the upper plate where no channel is formed and a thickness of the gas injection port is less than or equal to a thickness of the channel.

7. The structure of claim 1, further comprising a sealing tube positioned between the mercury vapor diffusing pipe and the mercury vapor diffusing port.

8. An injection structure for a flat fluorescent lamp (FFL), the FFL having a lower plate, an upper plate, and a channel formed therebetween, the structure comprising:

a first port connected to a first portion of the channel, wherein the first port is in communication with an interior of the channel;

a first pipe configured to be inserted into the first port such that the first port and the first pipe are aligned along the same central axis; and sealing material provided in the first port between an end of the first pipe and an entrance into the channel, the sealing material having a passage extending therethrough.

9. The structure of claim 8, further comprising a sealing tube positioned between the first port and the first pipe.

10. The structure of claim 8, further comprising a getter positioned in the first port between the end of the first pipe and the sealing material, wherein the first port and the first pipe are configured to draw air out of the channel to form a vacuum, to inject gas into the channel, and to diffuse vapor generated by the getter into the channel.

11. The structure of claim 10, wherein the getter comprises a mercury getter, and wherein the port and the pipe are configured to inject inert gas into the channel and to diffuse mercury vapor into the channel.

12. The structure of claim 8, further comprising:

a second port connected to a second portion of the channel, wherein the second port is in communication with the interior of the channel; and a second pipe configured to be inserted into the second port such that the second port and the second pipe are aligned along the same central axis.

13. The structure of claim 12, further comprising a sealing tube positioned between the second port and the second pipe.

14. The structure of claim 12, wherein the first port and the first pipe are configured to draw air out of the channel so as to create a vacuum in the channel, and to inject an inert gas into the vacuumized channel, and the second port and second pipe are configured to diffuse vapor into the vacuumized channel.

15. The structure of claim 12, wherein the second pipe comprises a closed end and an open end, wherein the open end is inserted into the second port, and wherein a mercury getter is provided in the closed end.

16. The structure of claim 15, further comprising a sealing material is provided between the open end of the second pipe and an entrance into the channel, the sealing material comprising a passage extending from a first end of the sealing material to a second end of the sealing material, wherein the sealing material is configured to close off the passage extending therethrough in response to heat so as to form a seal within the second port that inhibits flow into and out of the channel through the second port.

17. The structure of claim 12, wherein the second port is formed at an edge portion of the upper plate where no channel is formed and a thickness of the second port is less than or equal to a thickness of the channel.

18. The structure of claim 8, further comprising:

a second port provided proximate the first port;

a second pipe configured to be inserted into the second port such that the second port and the second pipe are aligned along the same central axis; and a connection passage that extends from the second port to the first port so as to provide for communication therebetween.

19. The structure of claim 18, wherein the second port is formed at an edge portion of the upper plate where no channel is formed and a thickness of the second port is less than or equal to a thickness of the channel.

20. The structure of claim 8, wherein the first port is formed at an edge portion of the upper plate where no channel is formed and a thickness of the first port is less than or equal to a thickness of the channel.

* * * * *